US006657381B1

(12) United States Patent
Arutaki

(10) Patent No.: US 6,657,381 B1
(45) Date of Patent: Dec. 2, 2003

(54) DISPLAY DEVICE HAVING A MULTI-LAYERED STRUCTURE WITH LIGHT-EMITTING DEVICES MOUNTED THEREON

(76) Inventor: Makoto Arutaki, 4-25-406, Kakyoin 1-chome, Aobu-ku, Sendai-shi, Miyagi-ken 980-0013 (JP)

( * ) Notice: Subject to any disclaimer, the term of this patent is extended or adjusted under 35 U.S.C. 154(b) by 53 days.

(21) Appl. No.: 09/699,722

(22) Filed: Oct. 30, 2000

(30) Foreign Application Priority Data

Dec. 13, 1999 (JP) ..... 11-353193
Apr. 12, 2000 (JP) ..... 2000-111176

(51) Int. Cl.[7] ..... H01J 1/62; H01J 63/04; F21V 1/00; F21V 11/00; F21S 13/14

(52) U.S. Cl. ..... 313/512; 362/252; 362/800; 362/238

(58) Field of Search ..... 313/512; 362/252, 362/800, 238

(56) References Cited

U.S. PATENT DOCUMENTS 1,067,024 A * 7/1913 Hall et al. ..... 40/550
3,873,885 A * 3/1975 Elfverson ..... 315/312
4,296,855 A * 10/1981 Blalock ..... 198/847
4,402,151 A * 9/1983 Medow ..... 40/569
4,920,467 A * 4/1990 Honsberger ..... 362/226
5,010,463 A * 4/1991 Ross ..... 362/253
5,837,971 A * 11/1998 Lee ..... 219/212

FOREIGN PATENT DOCUMENTS

JP SHO 47-22093 A 10/1972
JP SHO 49-5374 U 1/1974
JP SHO 60-189084 U 12/1985

* cited by examiner

*Primary Examiner*—Nimeshkumar D. Patel
*Assistant Examiner*—Matt Hodges
(74) *Attorney, Agent, or Firm*—Duane Morris LLP

(57) ABSTRACT

A display device (1) includes a multi-layered structure (10) and a plurality of light-emitting devices (31) mounted on a display surface of the multi-layered structure. The multi-layered structure includes successively stacked first, second and third insulating layers (11, 12, 13) with the first layer on the display surface side, a first conductive layer (21) sandwiched between the first and second insulating layers, and a second conductive layer (2) sandwiched between the second and third insulating layers. Each of the first, second and third insulating layers is formed of such a material that a needle or the like can be stuck into it. Also, each of the first and second conductive layers is a layer of fibers, into which a needle or the like can be stuck.

2 Claims, 12 Drawing Sheets

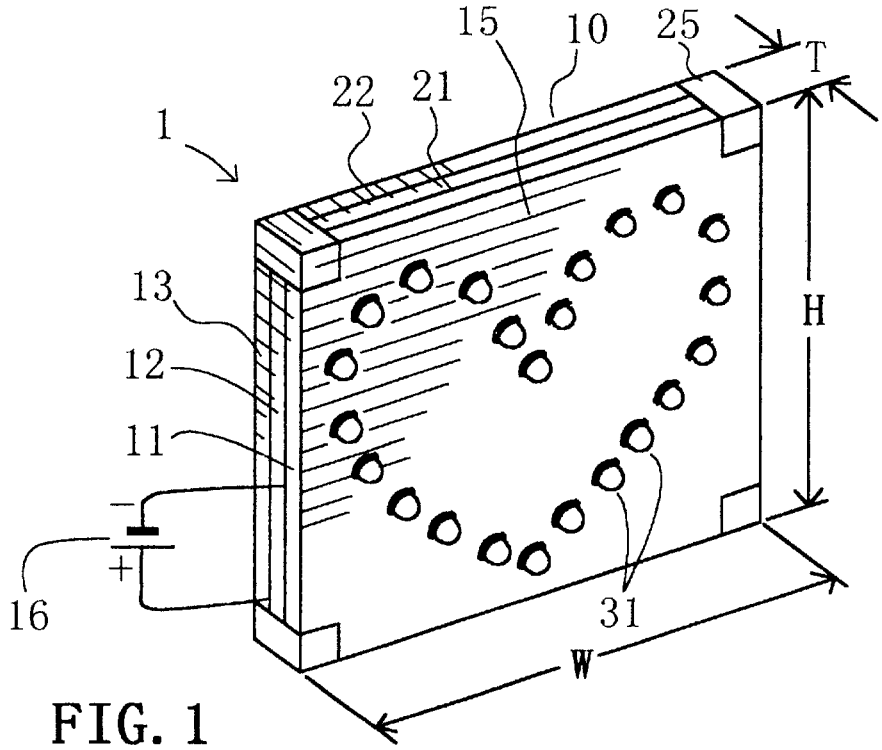
FIG. 1
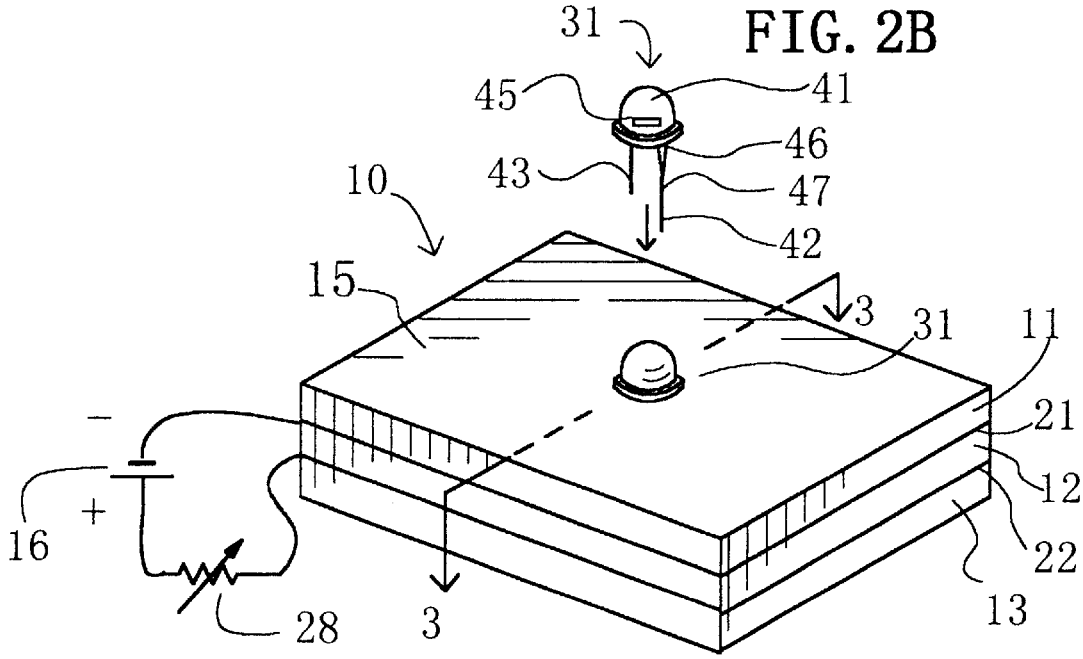
FIG. 2B
FIG. 2A

FIG. 3
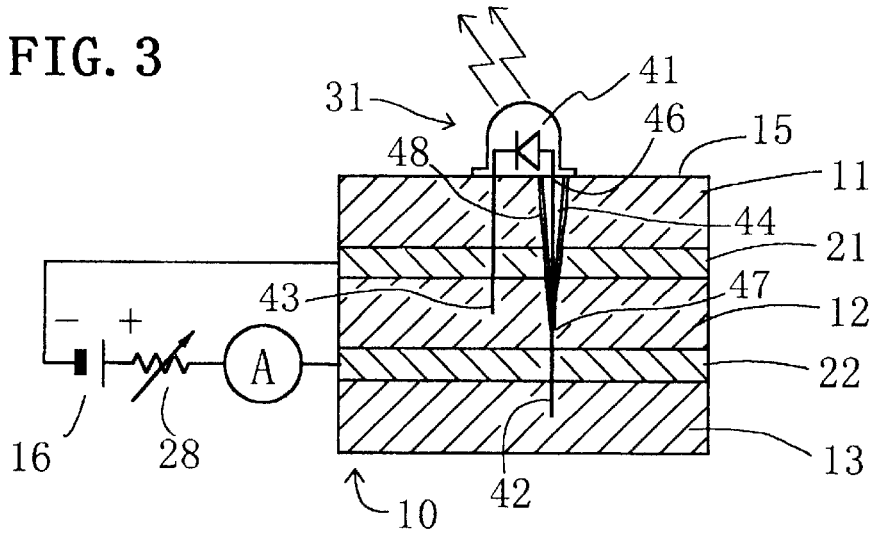
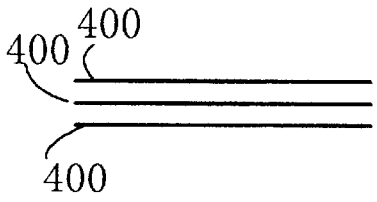
FIG. 4A
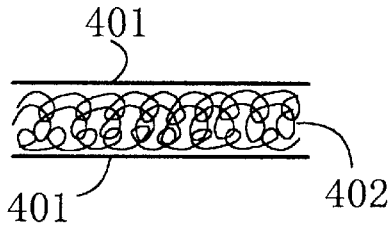
FIG. 4B
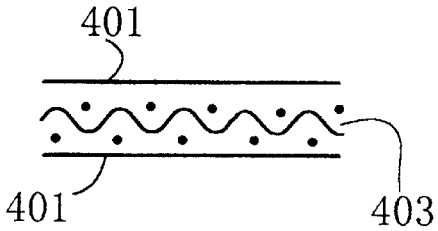
FIG. 4C
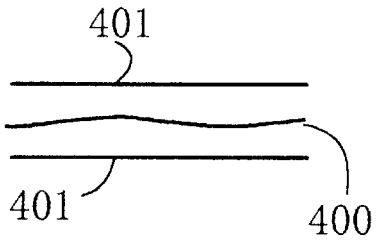
FIG. 4D

DISPLAY DEVICE HAVING A MULTI-LAYERED STRUCTURE WITH LIGHT-EMITTING DEVICES MOUNTED THEREON

This invention relates to a display device with a plurality of light-emitting devices mounted at desired locations on a display surface of a multi-layered structure of the display device, and to a multi-layered structure and light-emitting devices for such display device.

BACKGROUND OF THE INVENTION

In his Japanese Unexamined UM Publication No. SHO 60-189084 U published on Dec. 14, 1985, Y. Nagai discloses an electric light board including light-emitting diodes each having a shorter electrode plug and a longer electrode plug of which a portion is insulated. The light-emitting diodes are pushed into a board including a plurality of soft, electrically conductive sheets and a plurality of soft, electrically insulating sheets. Y. Nagai does not show materials of the soft, electrically conductive sheets.

K. Kato et al., in their Japanese Unexamined UM Publication No. SHO 49-5374 U published on Jan. 17, 1974, disclose a position indicating device including light-emitting diodes each having a shorter electrode and a longer electrode with an insulating layer thereon, and a display plate including two conductive thin sheets with an insulating thin sheet interposed between the two conductive sheets. The conductive sheets are formed of metal, or rubber or synthetic resin with minute particles of conductive material mixed therein.

In Japanese Unexamined Patent Publication No. SHO 47-22093 A published on Oct. 6, 1972, S. Wada shows a display device including a laminate sheet of two or three conductive layers of metal or conductive resin and two or three insulating layers of soft synthetic resin, and light-emitting diodes each having longer and shorter contact needles coated with insulating material except the respective end portions thereof. The contact needles of the light-emitting diodes are pushed into the laminate sheet so as to contact the associated conductive layers.

With the above-described arrangements of the prior art display devices, electrical contact between the light-emitting diodes and the conductive layers is insufficient and unstable. In some cases, some diodes may lose sufficient electrical contact, which makes the diodes unable to emit light, or contact portions may be oxidized as time passes, so that power cannot be supplied to the diodes.

An object of the present invention is to provide a display device having a display surface, and a light-emitting device which can be mounted at substantially any desired position on the display surface. Another object of the present invention is to provide a conductive layer for a multi-layered structure for such display device, which can provide stable conductive contact with leads of a light-emitting device to be pushed into the multi-layered structure. A still further object of the present invention is to provide a display device in which a light-emitting device to be energized can be selected.

SUMMARY OF THE INVENTION

A display device according to the present invention includes a multi-layered structure and a plurality of light-emitting devices mounted on a display surface of the multi-layered structure. The multi-layered structure includes successively stacked first, second and third insulating layers with the first layer on the display surface side, a first conductive layer sandwiched between the first and second insulating layers, and a second conductive layer sandwiched between the second and third insulating layers. Each of the first, second and third insulating layers is formed of such a material that a needle or the like can be stuck into it. Also, each of the first and second conductive layers is a layer into which a needle or the like can be stuck and which contains fibers. Each of the light-emitting devices has a longer lead and a shorter lead, which are stuck into the multi-layered structure through the display surface at substantially any desired location. When stuck, the longer lead extends through the first and second insulating layers and the first conductive layer at least into the second conductive layer and contacts the second conductive layer. An insulating coating or covering is provided on the longer lead at a portion thereof which contacts the first conductive layer in the multi-layered structure when the longer lead is stuck into the multi-layered structure. This insulating coating insulates the longer lead from the first conductive layer. The shorter lead extends through the first insulating layer at least into the first conductive layer and contacts the first conductive layer when it is stuck into the multi-layered structure.

The first, second and third insulating layers may be of insulating foamed plastic.

At least one of the first and second conductive layers may be separated into plural sections of desired shapes.

The longer lead of each light-emitting device may be provided with an insulating coating on at least a part of a proximal portion thereof having a length equal to that of the shorter lead. The insulating coating has its distal end narrowed down.

The first and second conductive layers include woven or non-woven fabric. The fabric can establish stable electric contact between the leads of the light-emitting devices and the conductor layers.

BRIEF DESCRIPTION OF THE DRAWINGS

FIG. 1 is a perspective view of a display device according to the present invention.

FIG. 2A is a perspective view of a signboard for use in explaining the principle of the present invention, and FIG. 2B is a light-emitting diode (LED), showing how it is stuck into the signboard.

FIG. 3 is a cross-sectional view of the signboard along a line 3—3 in FIG. 2A.

FIGS. 4A, 4B, 4C and 4D show examples of conductive layers of the display device of the present invention.

DETAILED DESCRIPTION OF EMBODIMENTS

Figures 5A, 5B, 5C, 5D, 5E:
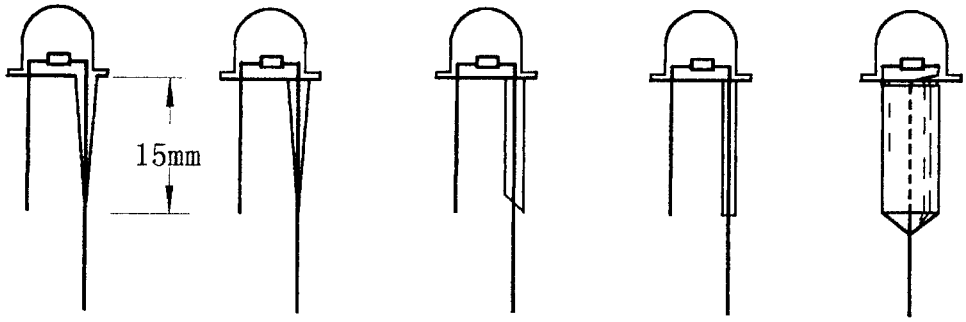
FIGS. 5A, 5B, 5C, 5D, and 5E show various examples of LEDs useable in the present invention.

Now, embodiments of the present invention are described with reference to the accompany drawings. Throughout the drawings, the same reference numerals are attached to the same or similar components.

FIG. 1 shows a perspective view of a multi-layered signboard 1 according to one embodiment of the present invention. The signboard 1 includes a multi-layered board 10 including three stacked insulating layers or boards 11, 12 and 13, and two soft conductive layers 21 and 22. The conductive layer 21 is interposed between the insulating layers 11 and 12, and the conductive layer 22 is interposed between the insulating layers 12 and 13. The signboard 1 further includes a plurality of LEDs 31 or light-emitting devices mounted on one display surface 15 of the board 1, being stuck into the multi-layered structure. The shapes of the multi-layered structure and the display surface shown in FIG. 1 are flat and rectangular, but they may be circular, elliptic, stellar or of any other shape. The multi-layered structure may be shaped into a globe, a truncated cone, or any other curved shape, so the display surface is curved.

The conductive layers 21 and 22 are connected to power supply lines connected to the plus (+) and minus (−) terminals of a power supply 16. In the arrangement shown in FIG. 1, the conductive layer 21 is connected to the minus (−) terminal of the power supply 16, while the conductive layer 22 is connected to, the plus (+) terminal of the power supply 16.

Each of the LEDs 31 includes a light-emitting portion 41 and a pair of cathode and anode leads 41 and 42. The leads 41 and 42 have respective lengths corresponding to the depths of the conductive layers 21 and 22 from the display surface, respectively, which are poled similarly to the leads 41 and 42, respectively. In FIGS. 2B and 3, the structure of each of the LEDs 31 is shown in greater detail. The longer lead 42 is provided with an insulating coating 44 over at least a portion which would contact the conductive layer 21 when the diode 31 is stuck into the multi-layered structure. Preferably, the insulating coating 44 extends from the proximal end 46 to a mid portion 47 of the lead 42. The length of the insulating coating 44, i.e. the distance between the proximal end 46 and the mid portion 47, is slightly larger than the sum of the insulating layer 11 and the conductive layer 21.

The insulating coating 44 has preferably a larger thickness at the proximal end portion 46, tapering toward the mid portion 47, which gives a larger contact area to the lead 42 with respect to the inner wall off the hole formed by the lead 42 in the multi-layered board 10. The larger contact area, in combination with the elasticity and static friction provided by the foamed plastic of the board, makes the LED 31 more firmly secured to the multi-layered board 10.

FIGS. 2A, 2B and 3 are for explaining the principle of the present invention. FIG. 2B shows how a LED 31 is stuck into the multi-layered board 10, and FIG. 2A shows the LED 31 stuck into the board 10. FIG. 3 is a cross-section along a line 3—3 in FIG. 2.

The cathode and anode leads of a DC power supply (about 2 V) 16 are connected, optionally through a variable resistor 28, to the conductive layers 21 and 22, respectively, of the multi-layered board 10. The leads 42 and 43 of the LED 31 are stuck into the board through the display surface 15. The shorter lead 43 extends through the first insulating layer 11 and the first conductive layer 21 into the second insulating layer 12, establishing an electrical contact between the lead 43 and the first conductive layer 21. The longer lead 42 extends through the first insulating layer 11, the first conductive layer 21, the second insulating layer 12 and the second conductive layer 22 into the third insulating layer 13, establishing electrical contact between the lead 42 and the second conductive layer 22 with the insulating coating 44 thereon isolating the lead 42 from the first conductive layer 21. When forward current (of about 20 mA) is supplied to flow between the two leads, the LED 31 emits light.

Next, the insulating layers 11, 12 and 13 are described. The insulating layers 11, 12 and 13 shown in FIGS. 1–3 are preferably of a material which is relatively soft, exhibits some hardness when compressed, and is hard to deform, and into which a needle or the like can be stuck to form a hole therein. In the illustrated embodiments, foamed plastic layers having a thickness of, for example, 10 mm or 5 mm, are used. Typically, foamed polystyrene is used for the insulating layers, but other foamed plastics, such as foamed polyurethane, foamed polyethylene or the like can be used.

Alternatively, fiber layers having insulating property, such as insulating chemical fiber layers, may be used as the insulating layers of the present invention.

Multi-layered boards including three insulating layers having a thickness of 10 mm and 5 mm, and two conductive layers sandwiched between two adjacent insulating layers were experimentally prepared. The boards have various dimensions. The fabricated multi-layered boards had a thickness T (FIG. 1) of from about 15 mm to about 30 mm, a height H of from about 75 mm to about 900 mm, and a width W of from about 75 mm to about 600 mm. As shown in FIG. 3, a pointed needle like a paper fixing pin was stuck into the boards to thereby form guide holes 48, and, then, electrodes of LEDs 31 could be inserted into the guide holes 48 and, hence, into the multi-layered boards 10 with ease. Since electrodes of ordinary LEDs are rigid, they can be stuck directly into the boards without forming the guide holes 48 beforehand.

The respective layers of the multi-layered board may be fixed together by means of insulating adhesive tapes 25 at four corners, as shown in FIG. 1, or they may be fixed together by bolts and nuts of insulating plastic at four corners. A pulp sheet or a plastic paper sheet which can be painted may be bonded by an adhesive to a display surface of the multi-layered board, so that any colors or drawings can be provided on the display surface of the display device.

Next, the conductive layers 21 and 22 are described in detail. Preferably, the material of the conductive layers 21 and 22 has high electrical conductivity and is such a material that guide holes for guiding the leads of the LEDs 31 as described above can be easily formed in them by sticking a needle into them and that sufficient electrical contact can be established between the conductive layers and the electrodes of the LEDs 31 inserted into the guide holes 48. Also, it is important that the conductive layers 21 and 22 can hold the leads of the LEDs 31 firmly so that the LEDs 31 do not easily slip off the board. Each of the conductive layers may have a single-layered or multi-layered structure.

Such material may be a soft and electrically conductive material which can be formed into a sheet and into which a needle can be easily stuck. Such materials include conductive fabric coated with a conductive metal, a fine stainless-steel net, steel wool, and woven or unwoven fabric of carbon fibers. One of them may be used as a single layer, or two or more may be combined to form a multi-layered conductive sheet. The conductive sheet may be used singly or in combination with one or more of aluminum foil, copper foil and shield paper which provide high conductivity within the layer.

The metal-coated fabric may be woven or unwoven fabric of synthetic fibers, other chemical fibers or natural fibers coated with copper and/or nickel. The fibers include, for example, polyester, acrylic, and nylon fibers.

A fabric is preferred as the material for the conductive layers because it is easily handled, and easily cut, and hardly tears. A woven or unwoven fabric of conductive metal-coated synthetic fibers can be obtained by plating fibers, threads or fabric with copper or nickel, or plating with copper and then nickel. Metal-coated conductive woven fabrics of polyester fibers or acrylic fibers are commercially available from Daiwabo Co., Ltd., Osaka, Japan for a material for shielding electronic devices from electromagnetic waves, and may not have been used for any other purposes than electromagnetic shielding.

The thickness of a metal-coated conductive fabric used in the experiment was about 0.1 mm to 0.2 mm, but thicker conductive layers may be used in the present invention. The inventor recognized that even a single metal-coated fabric exhibited sufficiently high conductivity.

FIG. 4A shows an example of a conductive layer 21 or 22 which is formed of a laminate of a plurality of conductive fabrics 400. FIG. 4B shows another example of a conductive layer 21 or 22, formed of two aluminum thin sheets 401 with a sheet of steel wool 402 sandwiched between them. FIG. 4C shows a conductive layer formed of two aluminum thin sheets 401 with a fine steel net 403 sandwiched between them. FIG. 4D shows a still other example of a conductive layer including two aluminum thin sheets 401 sandwiching a woven or unwoven fabric 400 of carbon fibers. Although not shown, a single conductive cloth coated with copper and/or nickel may be used. When a conductive layer is formed of a metallic material, such as aluminum and steel wool, it is preferable to coat it with an anticorrosive paint so that an oxide film can be hardly formed, which can keep good electrical contact between the conductive layer and the diode leads. The conductive layer is preferably bonded to the entire surface of a foamed plastic layer or part thereof by an adhesive or an adhesive tape so that it may not slip off. When the conductive layer is formed of a laminate of conductive sheets, the respective sheets may be bonded together by an adhesive or an adhesive tape put on the entire surfaces or part of one or both conductive sheets.

Next, the structure of a light-emitting device used in the present invention is described.

A LED 31 used as a light-emitting device mounted to the multi-layered board 10 shown in FIGS. 1–3 can be fabricated by working a commercially available LED. Typically, the LED 31 includes substantially parallel, thin, long needle-like leads or conductive legs having some rigidity, and a light-emitting section 41 including an LED pellet 45 encapsulated in plastic, e.g. epoxy resin. There are commercially available color-LEDs which emit color light, e.g. red, yellow, green and blue, and operate from various power levels, e.g. 2 V and 4 V. LEDs are preferable light-emitting devices because they are easily procured, have a long life, are small in size, and can be rendered conductive by selecting the direction of a bias voltage applied to it. However, other light-emitting semiconductor devices, i.e. electro-luminescent cells or small lamps with two parallel needle-like lead soldered to the lamps, may be used instead.

FIGS. 5A through FIGS. 5E show various examples of the LED 31 having different types of insulating coating or covering 44.

FIG. 5A shows a LED having a tapered insulating coating on the proximal portion of its longer electrode lead. The coating covers the proximal 15 mm portion of the lead. The LED can be used with a multi-layered board including insulating layers having a thickness of 10 mm. The insulating coating is formed of the same plastic material as the one used for encapsulating the light-emitting portion of the LED, and is integral with the plastic encapsulation.

The LED shown in FIG. 5B has a tapered insulating coating similar to the one shown in FIG. 5A. The insulating coating, however, of FIG. 5B is formed of a thermosetting plastic adhesive, which, when cured, is integral with the LED encapsulation and with the lead.

The insulating covering shown in FIG. 5C is provided with a separately prepared long sheathe or tube of hard, semihard or soft plastics, or rubber. Such plastic may be, for example, fluoroplastics or Teflon. The lead is inserted into the sheathe. If the sheathe is formed of hard plastics and has its distal end cut off obliquely, the lead with such plastic sheathe can be directly stuck into the board 10. Alternatively, a needle may be stuck into the board to form a guide hole in the board 10, the plastics tube is then placed in the guide hole, and after that, the lead of the LED is inserted into the plastics tube. If the tube is of hard plastics, the tube may be stuck into the board 10 without a guide hole pre-formed, and the lead of the LED can be inserted into the tube. The lead may be pulled out from the tube and, after that, a small amount of adhesive can be put into the tube before inserting the lead again, which makes the lead firmly secured to the plastics tube.

FIG. 5D shows the insulating covering provided by wrapping an insulating plastic adhesive tape around the lead portion.

FIG. 5E shows a LED having two, concentrically formed leads. The longer lead is needle-shaped and centrally extends, while the shorter lead is cylinder-shaped surrounding the need-like longer lead. Insulating plastics is placed into the space between the longer and shorter leads to provide insulation between them. Although not shown, insulating enamel or adhesive may be applied to the proximal portion of the longer lead in a substantially uniform thickness.

Figure 6:
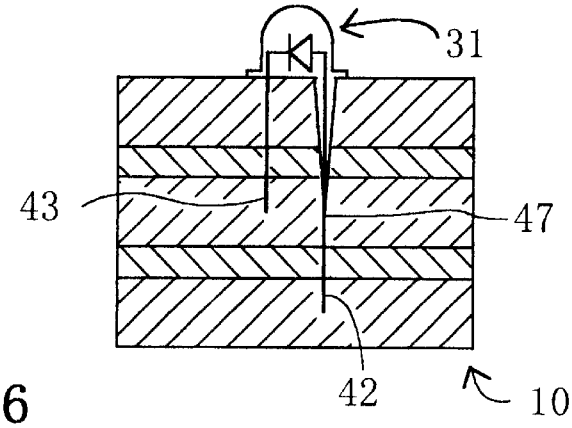
FIG. 6 is a cross-sectional view similar to FIG. 3, showing the LED of FIG. 5A stuck into a multi-layered board.

If the insulating covering is firmly bonded to the lead, the lead can be directly stuck into the multi-layered board, as shown in FIG. 6. On the other hand, if the lead with weak bonding between the lead and the insulating covering is stuck directly into the multi-layered board, the insulating covering may be removed or peeled off. In such case, a guide hole, like the hole 48 shown in FIG. 3, is preferably formed in the board beforehand, and the lead with such insulating covering is inserted into the guide hole.

Figures 7A, 7B, 7C:
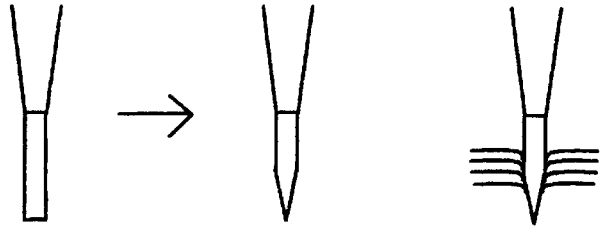
FIGS. 7A and 7B show how a lead is shaped.
FIG. 7C shows how the shaped lead can well contact the surrounding conductive layer.

The distal end of each lead of the LED can be tapered as shown in FIGS. 7A and 7B, so that the leads can be stuck into the board more easily, and firm electrical contact can be provided between the leads and the conductive layers as shown in FIG. 7C.

Figure 8A:
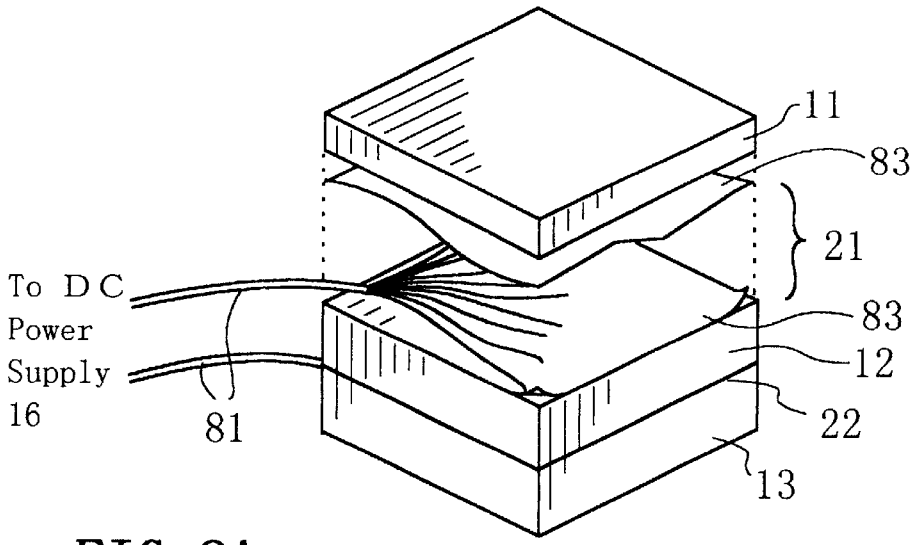
FIGS. 8A and 8B show how the conductive layers are connected to power supply cables.

Referring now to FIG. 8A, how to connect power supply lines 81 to the conductive layers 21 and 22 is described. In the example shown in FIG. 8A, each of the conductive layers 21 and 22 includes two conductive sheets, e.g. metal coated woven fabrics 83. The other ends of the power supply lines 81 are connected to a DC power supply, such as the battery 16 shown, for example, in FIG. 1. Each of the power supply lines 81 shown in FIG. 8A is a cable including a plurality of copper thin wires covered with an insulating vinyl covering. (Of course, a single wire line may be used instead.) The vinyl covering at the end of each cable to be connected to the conductive sheet 21 (22) is removed, and the copper thin wires are unbraided and spread into a fan-shape. Then, the spread copper wires are placed on one surface of one of the conductive sheets 83 and urged to contact that conductive sheet 83. Spray starch is sprayed to secured the wires to the conductive layer. The wires may be soldered instead. Over the surface on which the copper wires are bonded, the other conductive sheet 83 is placed. If the conductive layer is single-layered, the copper wires are sandwiched between the conductive layer and one of the insulating layers. If the conductive layer includes more than two conductive sheets, the copper wires are placed between two of adjacent conductive sheets.

Figure 8B:
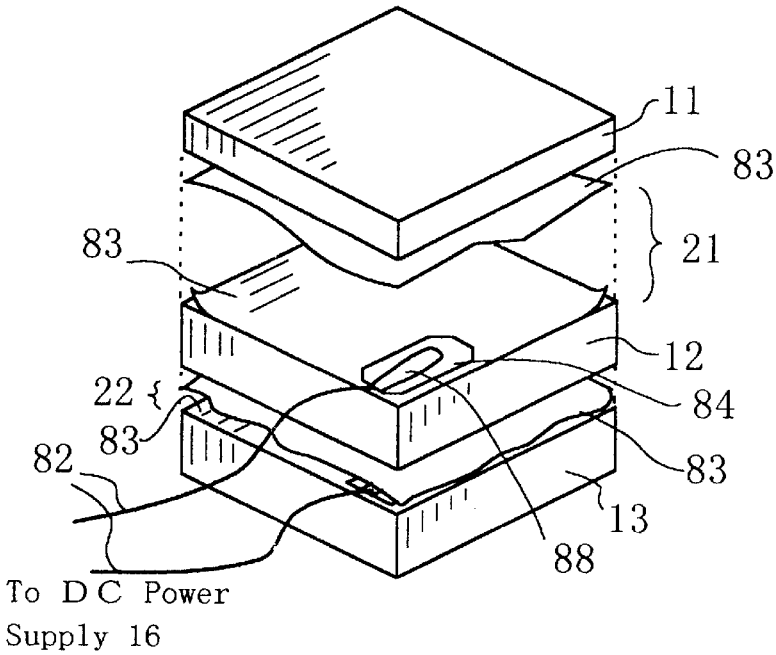
Figure 8C:
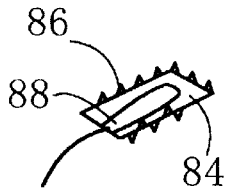
FIG. 8C shows another example of a power supply copper plate.

FIG. 8B shows another way of connecting the conductive layers 21 and 22 to power supply lines 82, which may be a cable like the cable 81 or a single conductor. One end of each line 82 is secured to one surface of a small copper square sheet by solder 88 to thereby form a small power supply copper electrode plate 84. The electrode plate 84 is placed between the conductive layer 21 (22) and one of the adjacent insulating layers 11 and 12 (12 and 13). Alternatively, the electrode plate 84 is placed between the two conductive sheets 83. The copper plate 84 may be formed sawtooth as shown in FIG. 8C, with the teeth 86 extending in the direction transverse to the plane of the conductive layer. In the example shown in FIG. 8C, alternate teeth 86 extend in one direction, while the other teeth in the opposite direction. When sandwiched between the insulating layer and the conductive layer and between two conductive sheets of the conductive layer, the copper electrode plate 84 is firmly secured to the conductive layer to thereby provide firm electrical contact between them.

The DC power supply can be a battery like the battery 16 shown, for example, in FIG. 1, or a DC power supply including rectifiers and a smoothing capacitor, connected to an AC power source, which is adjusted to supply current of about 20 mA to each LED. The current supplied may be preferably adjusted by a variable resistor or a selected one of fixed resistors connected in circuit with the power supply. LEDs with built-in resistor, e.g. LEDs having a voltage rating of 5V manufactured by Hewlett-Packard Company may be advantageously used, which eliminates the need for using a separate resistor.

According to the present invention, the LEDs with the above-described structure can be mounted at any desired locations on the multi-layered signboard. Since they need not be soldered, they can be removed. Accordingly, one can adjust the positions of the LEDs, considering the overall artistic effect of his or her work on the signboard, to produce his or her work in a pointillistic manner. Once the positions on the display surface of the respective LEDs are determined, they may be fixed to the display surface with an adhesive applied over the lower surfaces of the respective light-emitting portions or over portions of the leads.

Figure 9:
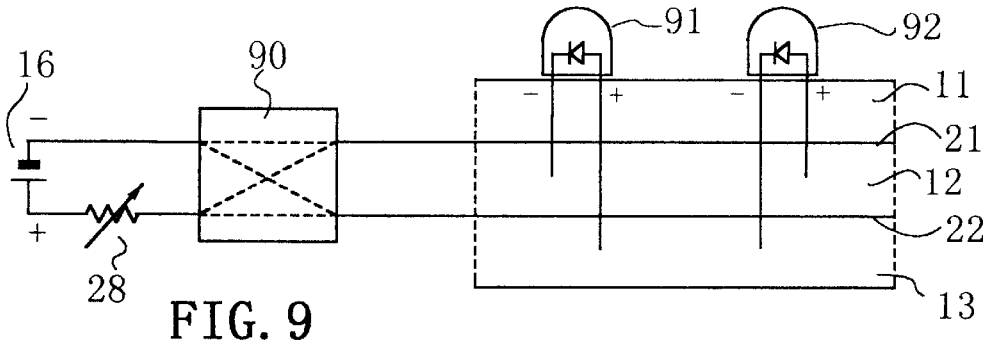
FIG. 9 shows a relay switch disposed between the display device and a power supply.

Referring to FIG. 9, the first conductive layer 21 is connected to the minus electrode of the battery 16, while the second conductive layer 22 is to the plus electrode. A LED 91 has a longer anode lead connected to its anode, and a shorter cathode lead connected to the cathode. Hereinafter, this type of LED is referred to as "+L-S LED". The signboard shown in FIG. 9 includes also another LED having a shorter anode lead and a longer cathode lead. This type of LED is referred to as "+S-L LED". The structure of the LED 91 is the same as the previously described LED 31, and the structure of the LED 92 is essentially the same as that of the LED 31 except that the longer lead is connected to the cathode of the LED 92. The longer leads are in electrical contact with the conductive layer 22, while the shorter lead is in electrical contact with the conductive layer 21. A relay switch 90 is used to switch the connection of the electrodes of the battery 16 to the conductive layers 21 and 22, which energizes the LEDs 91 and 92 to emit light alternately. A variable resistor 28 is connected between the battery 16 and the switch 90. Accordingly, two display patterns, one formed of plural diodes 91 with the other formed of plural diodes 92, can be selectively displayed by operating the relay switch 90.

Figure 10:
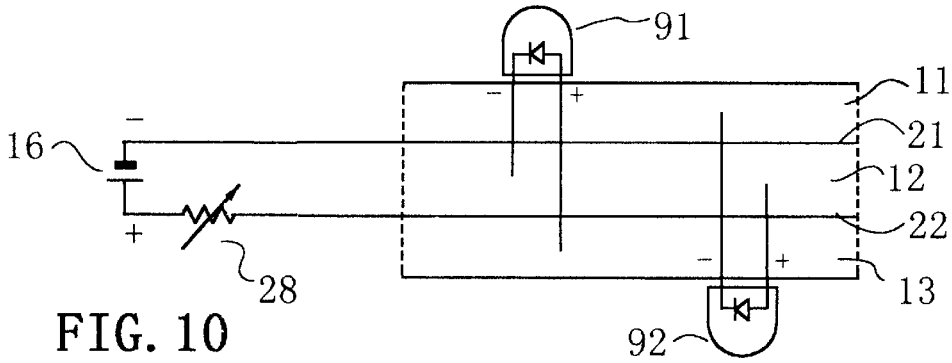
FIG. 10 shows a signboard with two display surfaces, and two LEDs which are respectively mounted on the two surfaces and can be turned on simultaneously.

FIG. 10 shows another example of signboard which has two display surfaces on opposite sides of the board. The two conductive layers 21 and 22 are connected in the same manner as in FIG. 9. FIG. 10 shows one +L-S LED 91 mounted on one display surface, the upper surface in FIG. 10, and one +S-L LED 92 mounted on the other, lower display surface. The variable resistor 28 is connected between the battery 16 and the conductive layer 22. The LEDs 91 and 92 of the signboard shown in FIG. 10 are energized simultaneously. A larger number of LEDs 91 and 92 can be mounted on the signboard.

Figure 11:
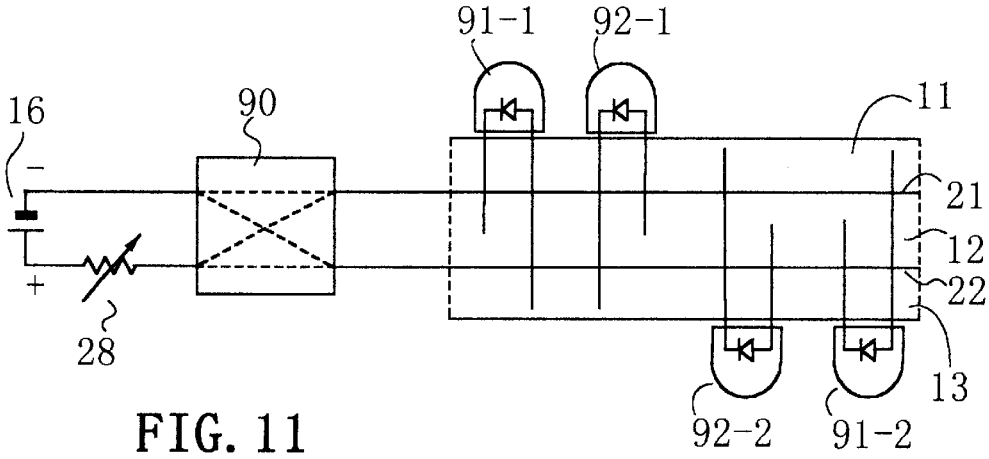
FIG. 11 shows a signboard with two display surfaces, and LEDs which are mounted on the two surfaces and can be turned on selectively.

Another example is shown in FIG. 11, in which there are shown two +L-S LEDs 91-1 and 91-2 and two +S-L LEDs 92-1 and 92-2 mounted on the opposite display surfaces of the signboard. The LEDs 91-1 and 92-1 are mounted on one display surface, and the LEDs 91-2 and 92-2 are on the opposite display surface. The variable resistor 28 is connected between the battery 16 and the switch 90. By switching the connections of the DC supply 16 between the conductive layers 21 and 22 with the relay switch 90, the LEDs on each display surface are alternately energized to emit light. Specifically, when the conductive layer 21 is connected through the switch 90 to the minus electrode of the battery 16, with the conductive layer 22 connected to the plus electrode of the battery 16, the LED 91-1 on the upper display surface and the LED 92-2 on the lower display surface are energized. When the switch 90 is switched to connect the conductive layer 21 to the plus electrode of the battery 16, the LEDs 92-1 and 91-2 emit light. A larger number of LEDs 91 (91-1, 91-2, . . . , 91-n) and 92 (92-1, 92-2, . . . , 92-n) can be mounted on the signboard to form two desired patterns on each of the display surfaces. By operating the relay switch 90, either one of the patterns on each display surface can be selected for display.

Figure 12:
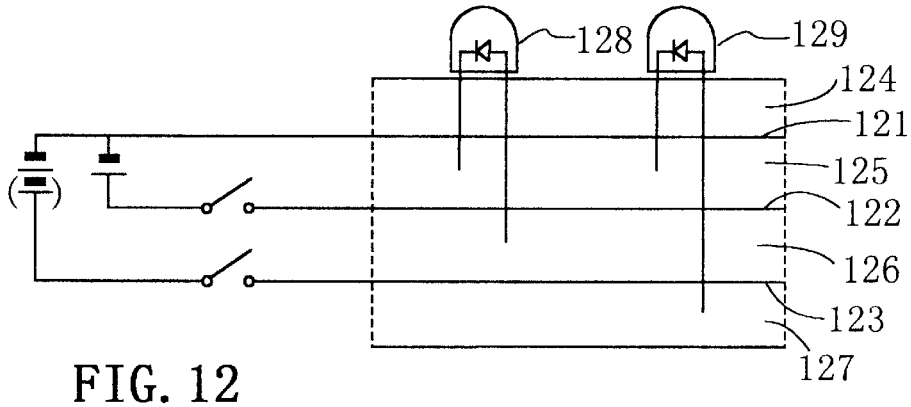
FIG. 12 shows a signboard with two different type LEDs mounted thereon, which are operated from different power supply voltages.

FIG. 12 shows another embodiment of the present invention. In this embodiment, the multi-layered display device includes four insulating layers 124, 125, 126 and 127 and three conductive layers 121, 122 and 123, and two types of LEDs 128 and 129. The lengths of the leads of the LEDs 128 and 129 are different. In the example shown in FIG. 10, the LED 128 has a shorter cathode lead which is in electrical contact with the first conductive layer 121, and a longer anode lead which is in electrical contact with the second conductive layer 122. The LED 129 has a shorter cathode lead which is in electrical contact with the first conductive layer 121, and a longer anode lead which is in electrical contact with the third conductive layer 123.

A voltage source of about 2 volts is connected between the first and second conductive layers 121 and 122 through a switch, and a different voltage source of about 2 volts is connected between the first and third conductive layers 121 and 123 through a switch. By selectively turning on and off the respective switches, the LEDs 128 and 129 are selectively turned on to emit light. When both switches are turned on, both LEDs 128 and 129 are energized to emit light. If the two types of LEDs have different operating voltages, for example, if the LED 128 operates with 2 V, while the LED 129 operates with 4 V, a 4 volt voltage source is connected between the first and third conductive layers 121 and 123.

A larger number of such LEDs 128 and 129 can be mounted on the signboard.

As is understood from this example, by using three or more conductive layers and different types of light-emitting devices having leads of different lengths, the different types of light-emitting devices can be mounted at desired locations on a display surface and can receive operating voltages necessary for them.

Figures 13A, 13B, 13C:
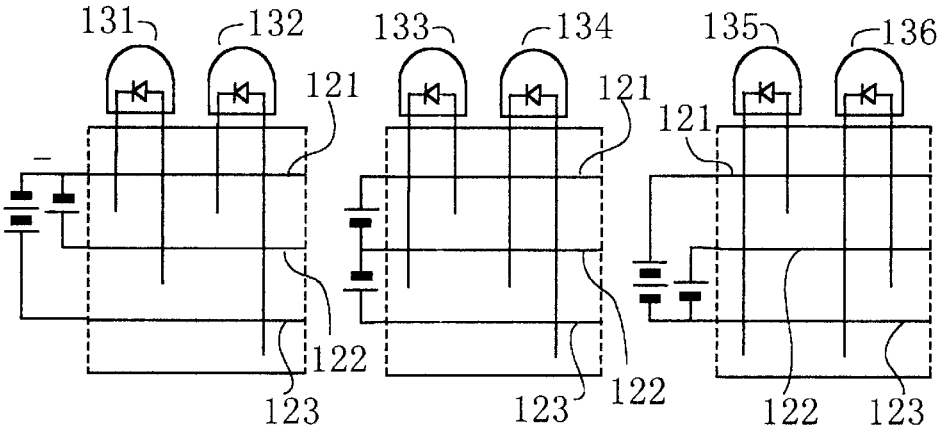
FIGS. 13A, 13B and 13C show LEDs having leads of various lengths for used with a signboard with three conductive layers.

As shown in FIGS. 13A, 13B and 13C and in TABLE I, there are six combinations of lengths of anode and cathode leads of LEDs which can be mounted on a display surface of a signboard having three conductive layers.

In TABLE I, "+" denotes an anode lead, and "–" denotes a cathode lead. A letter "S" represents a shorter lead, "M" does a middle-length lead, and "L" represents a longer lead. The shorter lead S extends to be in electrical contact with the first conductive layer 121, the middle-length lead M extends to be in electrical contact with the second conductive layer 122, and the longer lead L extends to be in electrical contact with the third conductive layer 123.

By using two different operating voltages of about 2 V and about 4 V with these LEDs, there are twelve combinations available. If LEDs emitting four colors of light are used in combination, there are forty-eight combinations. In FIGS. 13A–13C, various connections of a 2 V source and 4 V source are also shown.

TABLE I

| | | Length of Anode Lead (+) | | |
|---|---|---|---|---|
| | | S | M | L |
| Length of Cathode Lead (–) | S | None | +M–S | +L–S |
| | M | +S–M | None | +L–M |
| | L | +S–L | +M–L | None |

Figure 14A:
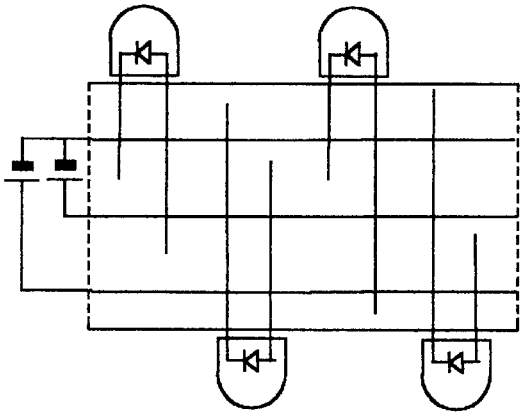
FIGS. 14A, 14B and 14C show LEDs mounted on a signboard with three conductive layers and two display surfaces.
Figure 14B:
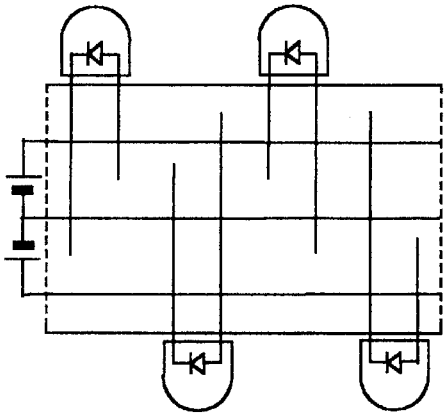
Figure 14C:
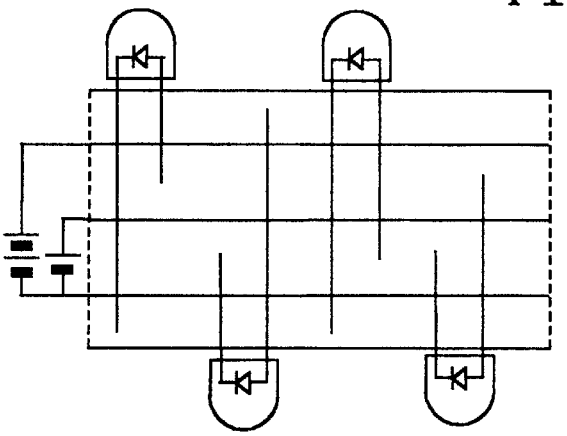

FIGS. 14A, 14B and 14C show another examples of signboards, which include three conductive layers and use two opposing surfaces as display surfaces. LEDs having shorter, middle-length and longer leads like those shown in FIGS. 13A–13C are used. Each of the shorter leads is in electrical contact with the nearest one of the three conductive layers. Each of the middle-length leads is in electrical contact with the middle one of the three conductive layers, and each of the longer leads is in electrical contact with the farthest one of the three conductive layers.

Figure 15A:
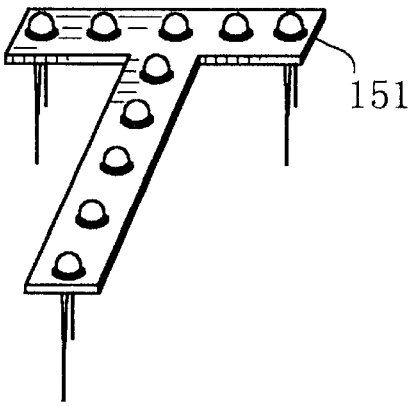
FIGS. 15A and 15B are perspective views showing top and bottom sides of an insulating strip having a predetermined shape, on which a plurality of LEDs are mounted.
Figure 15B:
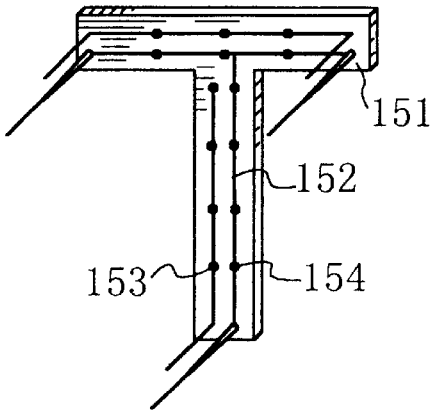

It may sometimes be difficult to display exactly desired characters, curves or shapes by directly mounting LEDs on a display surface of a multi-layered display board. In such a case, as shown in FIGS. 15A and 15B, a plurality of LEDs can be stuck into and bonded to a thin insulating strip 151 formed in a desired shape, e.g. T-shape. After that, the strip 151 with LED leads extending out from the bottom surface thereof (FIG. 15B) is mounted on the display surface by sticking the leads into the multi-layered board.

Although not shown, a plurality of LEDs are arranged adjacent each other to form a desired pattern without using a strip, and the light-emitting portions of adjacent LEDs may be bonded together by an adhesive, for example. Alternatively, the LEDs arranged in a pattern may be integrated by applying and curing resin to the light-emitting portions.

Such integrated LEDs may be divided into one or more groups, with a plurality of leads to be brought into contact with the same conductive layer interconnected by a conductor 152, for example, as shown in FIG. 15B. At least one of the interconnected leads is configured as a corresponding lead of, for example, the LED 31 shown in FIG. 3. The remaining leads, e.g. the leads 153 and 154, are cut short or bent to extend along the bottom surface of the strip 151. Then, the number of leads to be stuck into the multi-layered board is reduced, which facilitates the handling of LEDs.

In the above-described examples, the multi-layered board has flat surfaces. However, the multi-layered structure may be formed in a globe, a cylinder, a truncated-cone, or any other shape with a non-flat surface.

Figure 16A:
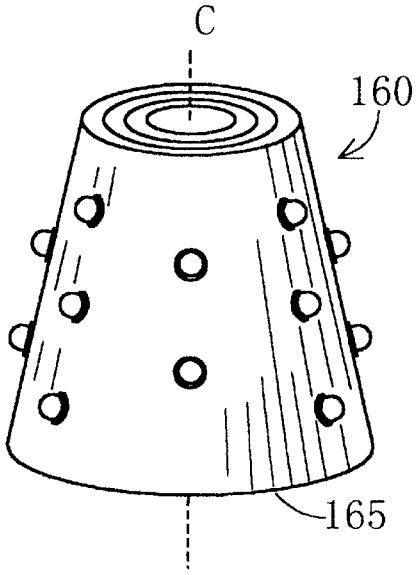
FIG. 16A is a perspective view of a display device having a multi-layered structure shaped in a truncated cone.
Figure 16B:
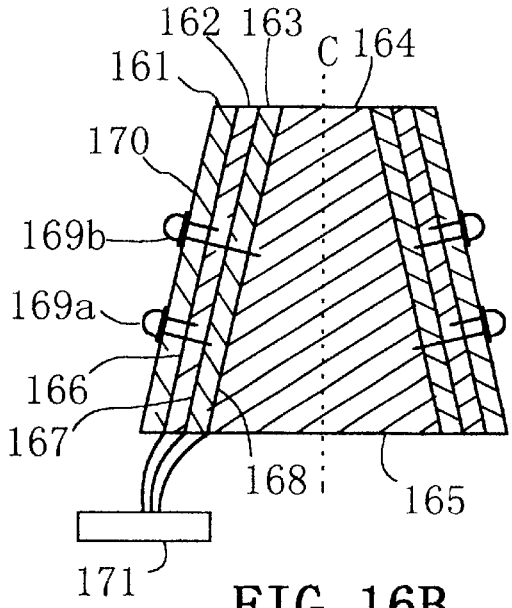
FIG. 16B is a vertical cross-sectional view of the display device shown in FIG. 16A.

FIG. 16A shows a truncated-cone shaped display device 160. FIG. 16B is a vertical cross-sectional view along a vertical plane containing the center axis C of FIG. 16A. The truncated-cone shaped multi-layered structure 165 has a display surface 170, four insulating, foamed plastics layers 161, 162, 163 and 164 successively disposed in the named order with the layer 161 disposed outmost. The structure further includes a first conductive layer 166 sandwiched between the insulating layers 161 and 162, a second conductive layer 167 sandwiched between the insulating layers 162 and 163, and a third conductive layer 168 sandwiched between the insulating layers 163 and 164. A plurality of LEDs 169*a* and 169*b* are mounted on the display device, with the three conductive layers 166, 167 and 168 are connected to a switching controller and power supply arrangement 171 shown in block.

Figure 17A:
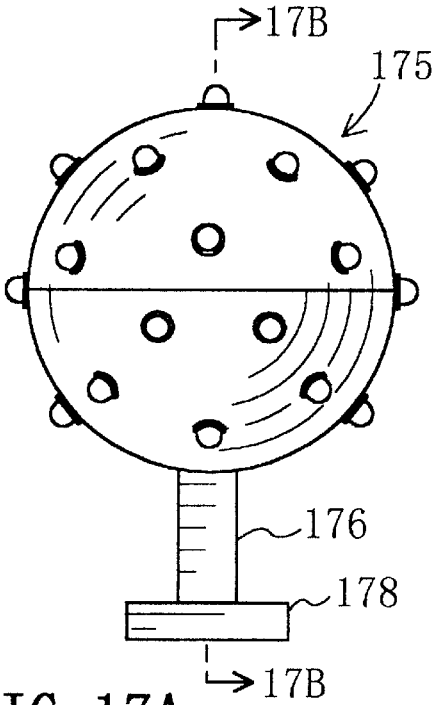
FIG. 17A is a front view of a display device according to the present invention having a multi-layered structure shaped in a ball.
Figure 17B:
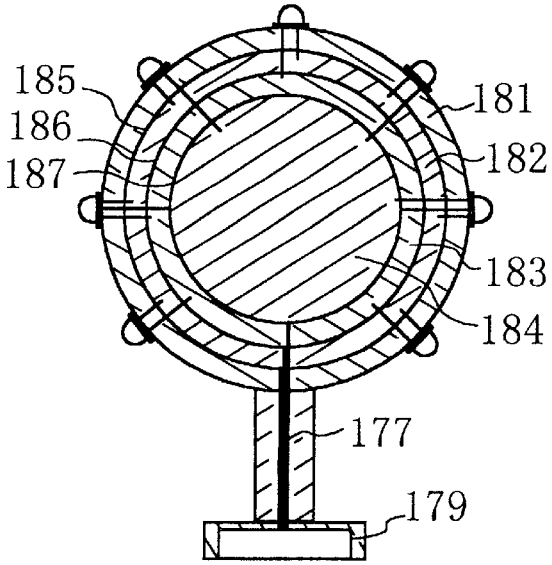
FIG. 17B is a vertical cross-sectional view of the display device of FIG. 17A.

FIG. 17A is a front view of a ball-shaped display device 175, and FIG. 17B is a vertical cross-sectional view along the line 17B—17B in FIG. 17A. The multi-layered structure used in this display device 175 includes successively stacked four insulating foamed plastics layers 181, 182, 183 and 184 with the layer 181 located outmost, conductive layers 185, 186 and 187 disposed between respective adjacent ones of the insulating layers 181–184. The display device 175 further includes a base 178 and a multi-layered structure supporting rod 176 extending upward from the base 178. A bundle of three power supply lines extends in the rod 176. A switching controller and DC power supply 179 is disposed in the base 178. The three power supply lines are connected between the DC power supply and the respective ones of the conductive layers.

Figure 18:
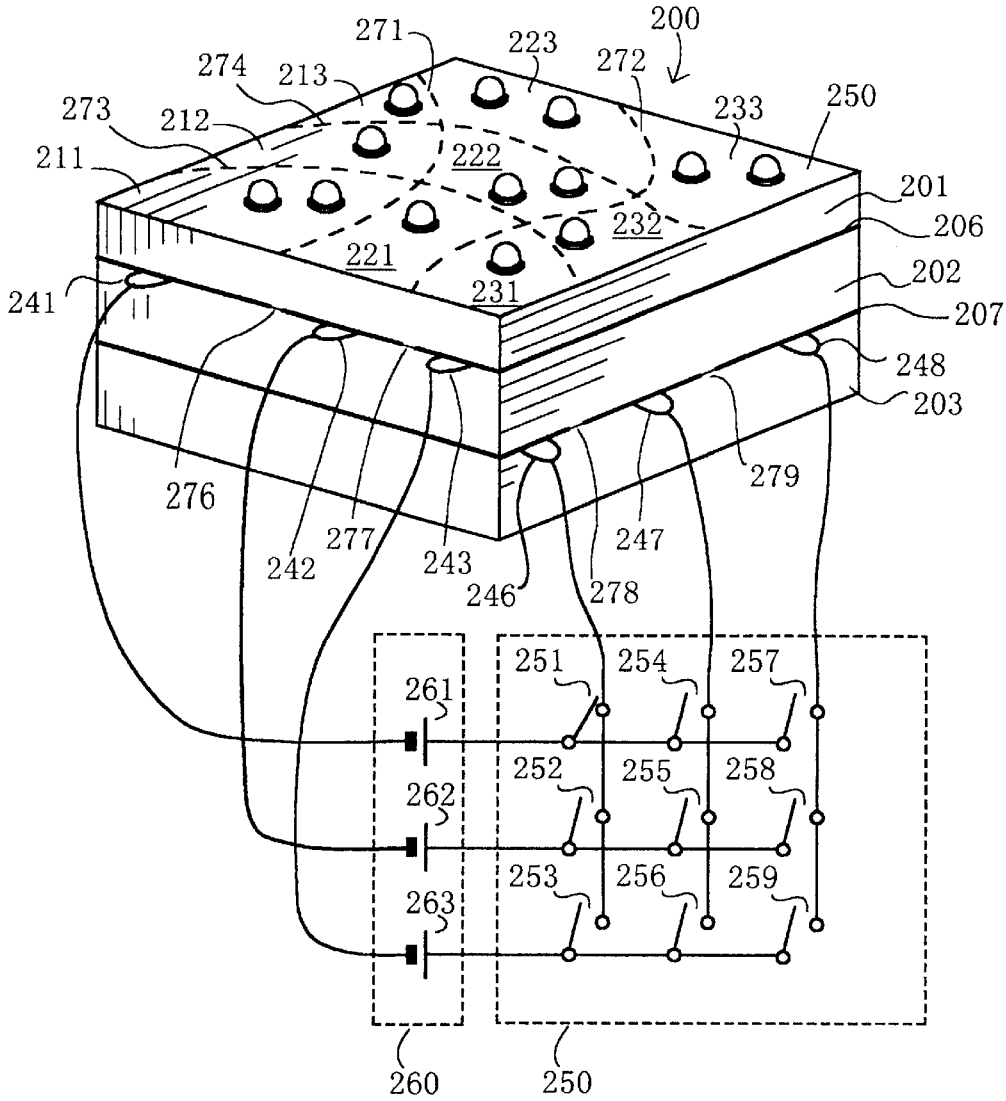
FIG. 18 is a schematic perspective view of a display device having a display surface divided into a plurality of display regions.

FIG. 18 shows another example of a display device 200 having a display surface divided into plural display regions. The multi-layered structure of the display device 200 includes first, second and third insulating layers 201, 202 and 203, and first conductive layer 206 disposed between the first and second insulating layers 201 and 202, and a second conductive layer 207 disposed between the second and third insulating layers 202 and 203.

Figure 19:
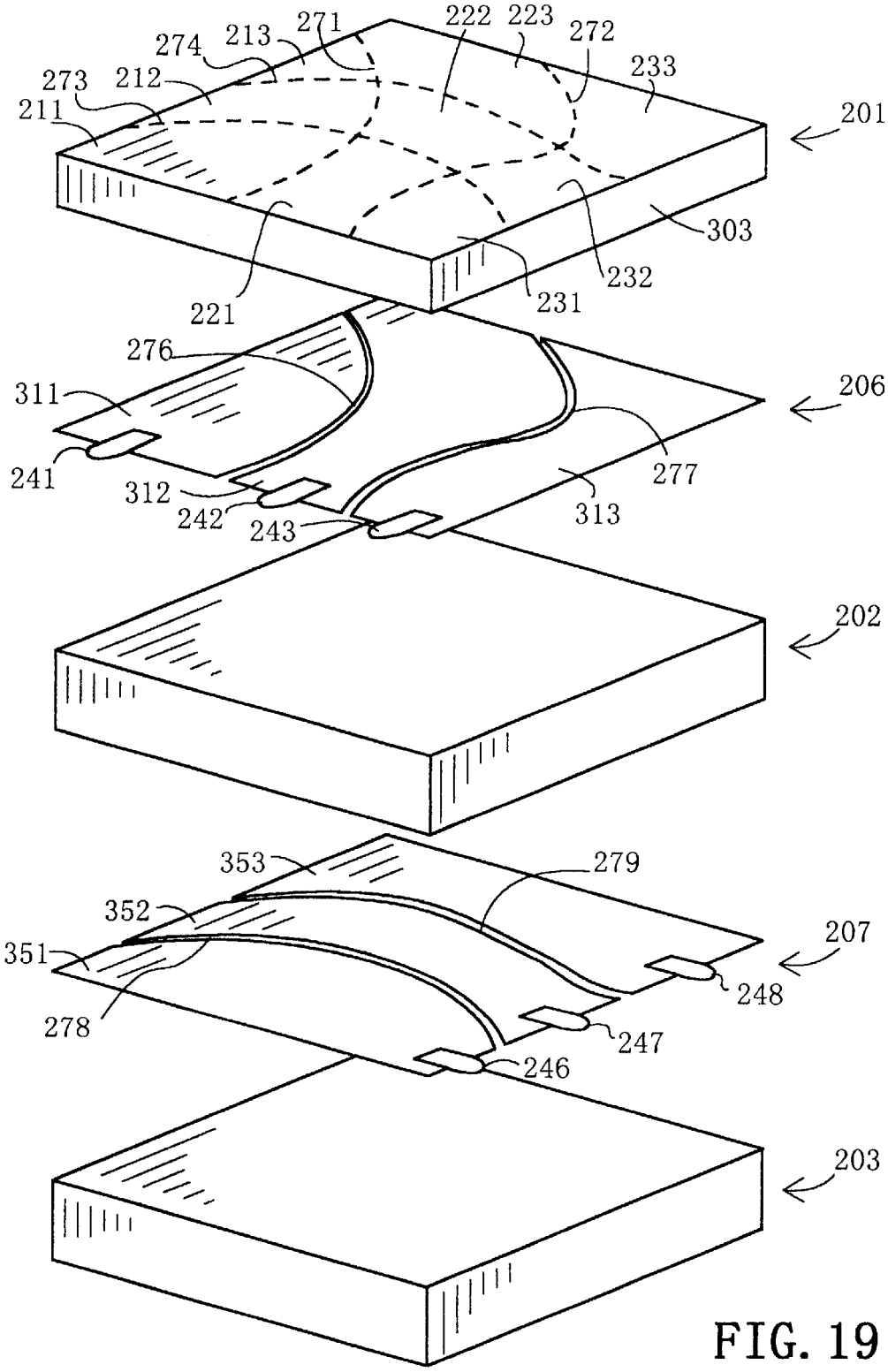
FIG. 19 is an exploded perspective view of the multi-layered structure of FIG. 18.

FIG. 19 is an exploded view of the multi-layered structure of FIG. 18 useful in explaining the structure. The first conductive layer 206 is divided into three regions 311, 312 and 313 by insulating gaps 276 and 277 formed in the layer 206. Electrodes 241, 242 and 243 are connected to the regions 311, 312 and 313, respectively. The second conductive layer 207 is divided into three regions 351, 352 and 353 by insulating gaps 278 and 279 which extend in the direction generally perpendicular to the gaps 276 and 277 in the first conductive layer 206. Electrodes 246, 247 and 248 are connected to the regions 351, 352 and 353, respectively.

In the laminated structure, the regions 311, 312 and 313 in the first conductive layer 206 overlap the regions 351, 352 and 353 in the second conductive layer 207. The electrodes 241, 242 and 243 are connected to the same polarity electrodes, the minus electrodes in the illustrated example, of three DC sources 261, 262 and 263 in a power supply apparatus 260, respectively, while the electrodes 246, 247 and 248 are connected through a switch apparatus 250 to the other polarity electrodes, the plus electrodes in the illustrated example, of the DC sources 261, 262 and 263, respectively. The switch apparatus 250 includes nine switches 251–259 arranged in a matrix. Broken lines 271, 272, 273 and 274 drawn on the upper, display surface 250 of the display device 200 shown in FIG. 18 are projections of the gaps 276 and 277 in the first conductive layer 206 and the gaps 278 and 279 in the second conductive layer 207. Thus, the display surface 250 is divided into nine display regions 211, 212, 213, 221, 222, 223, 231, 232 and 233. When LEDs are mounted on the display surface 250, they are divided into nine groups. When, for example, the switch 251 is closed, the LEDs in the region 211 are selected. If the switch 255 is closed in addition to the switch 251, the LEDs in the regions 211 and 222 are selected.

Figure 20:
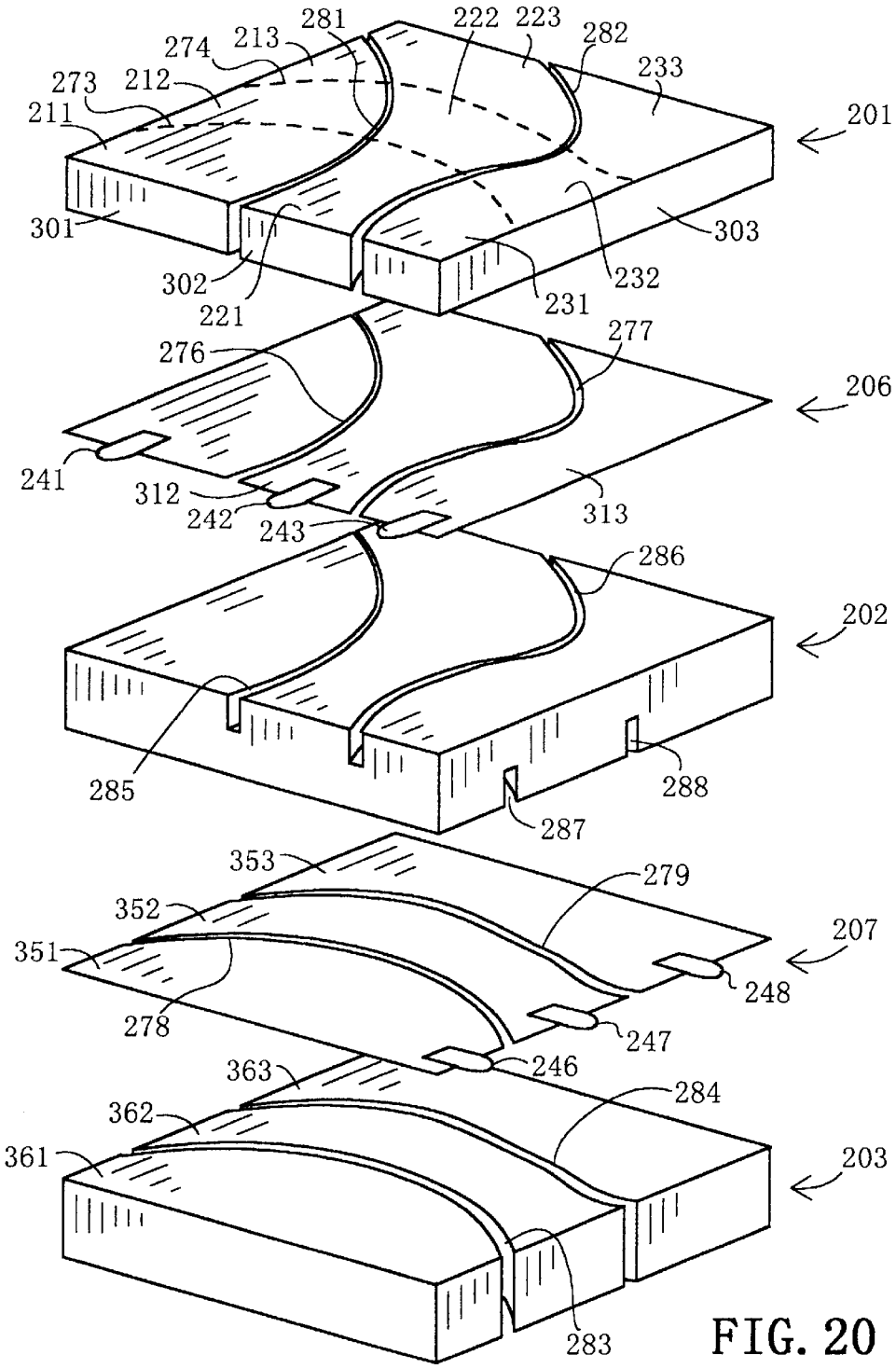
FIG. 20 is an exploded perspective view of a multi-layered structure different from the one shown in FIG. 19.

FIG. 20 is an exploded perspective view of another structure realizing the display device 200 shown in FIG. 18 having plural display regions. The display device 201 is essentially the same as the display device 200 shown in FIGS. 18 and 19, except that the insulating layers, too, are divided into plural portions. The first insulating layer 201 is divided into portions 301, 302 and 303 corresponding to the regions 311, 312 and 313 of the first conductive layer 206, by gaps 281 and 282 corresponding to the gaps 276 and 277 in the first conductive layer 206. The third insulating layer 203 is divided into three portions 361, 362 and 363 corresponding to the regions 351, 352 and 353 in the second conductive layers 207 by gaps 283 and 284 corresponding to the gaps 278 and 279 in the second conductive layer 207. There grooves 285 and 286 extending midway into the second insulating layer 202 from its upper surface, which correspond to the gaps 276 and 277 in the first conductive layer 206. There are two grooves 287 and 288 extending midway into the second insulating layer 202 from its bottom surface, which correspond to the gaps 278 and 279 in the second conductive layer 207. The gaps and grooves in the insulating layers and the gaps in the conductive layers can be left open, but they may be filled with insulating rubber, vinyl sheets or the like.

The structure shown in FIG. 20 results from cutting the gaps 281 and 282 in the laminate board from the upper, display surface to extend into the second insulating layer 202, which also results in forming the gaps 276 and 277 in the first conductive layer 206 and the grooves 285 and 286 in the second insulating layer 202, and cutting the gaps 283 and 284 in the laminate board from the bottom surface to extend into the second insulating layer 202, which also results in the formation of the gaps 278 and 279 in the second conductive layer 207 and the grooves 287 and 288 in the second insulating layer 202. When this method is employed, a display device essentially the same as the display device 200 shown in FIGS. 18 and 19 can be fabricated in a simple manner.

Figure 21:
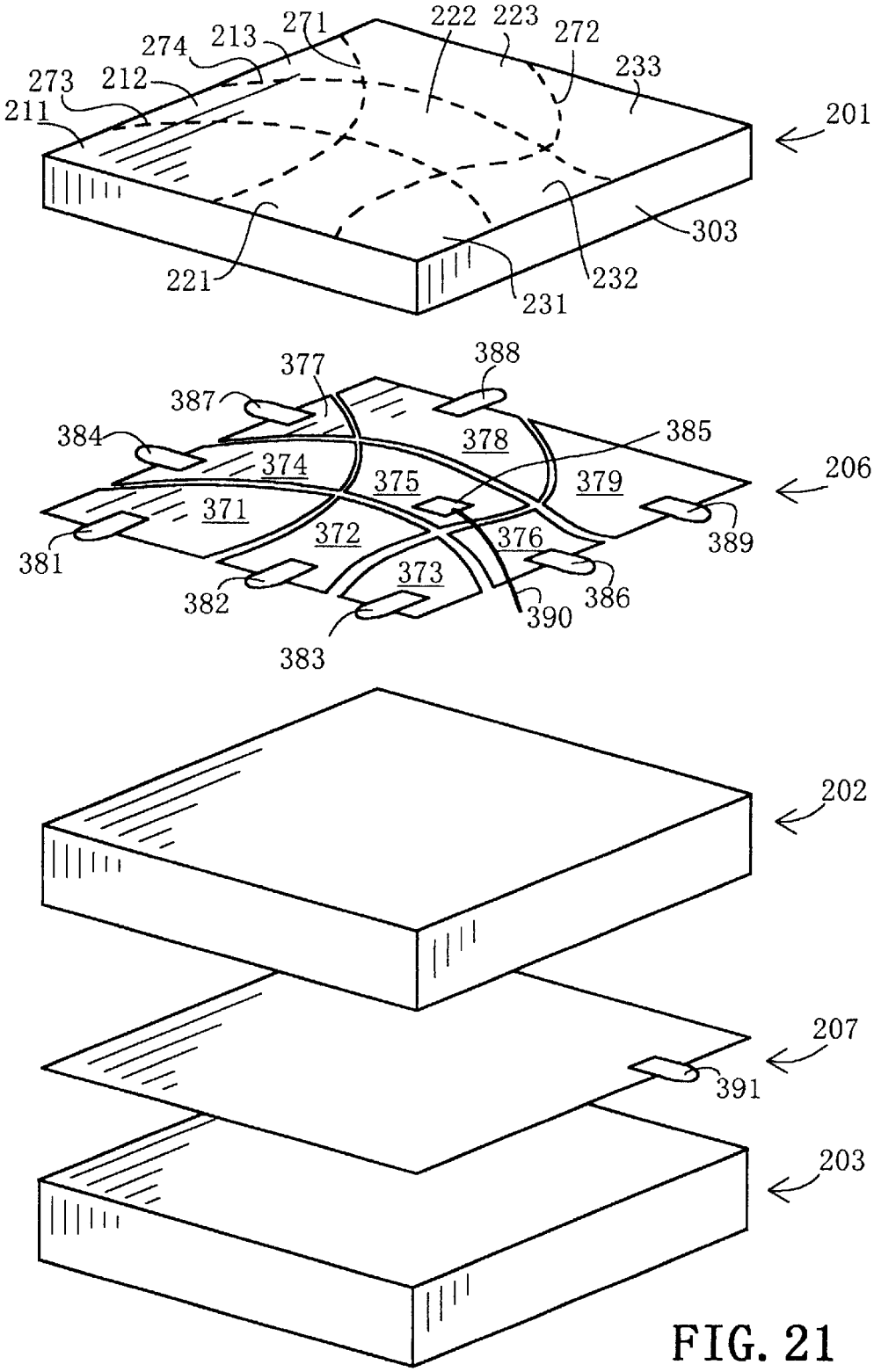
FIG. 21 is an exploded perspective view of another multi-layered structure.

FIG. 21 shows another structure for realizing the display device 200 shown in FIG. 18 having plural display regions. The first conductive layer 206 is divided into nine regions 371, 372, 373, 374, 375, 376, 377, 378 and 379 which correspond respectively to the display regions 211, 221, 231, 212, 222, 232, 213, 223 and 233. Electrodes 381–389 are connected respectively to the regions 371–379 in the first conductive layer 206. An electrode 391 is connected to the second conductive region 207. The electrodes 381–389 are connected through associated switches (not shown) to one en of a DC power supply (not shown), and the electrode 391 is connected to the other end of the DC power supply. By selective closing one or more switches connected to the respective regions 381–389 of the first conductive layer 206, the LEDs in the selected display regions are energized to emit light.

According to the present invention, a plurality of separate conducive layers and one or more light-emitting devices each having two leads connected to different ones of the conductive layers. Accordingly, it is not necessary to form two or more conductor strip patterns in one conductor position to apply a required voltage between the two leads of each light-emitting device. In contrast, when a printed circuit board is used to mount one or more light-emitting devices thereon, conductor patterns for applying at least two potentials must be formed on the board.

The display device of the present invention may be used as, for example, an artistic display, a signboard, a toy and a map board for selectively indicating the locations of famous places by light-emitting devices. The display device shown in FIG. 17 may be used as a sparkling ornament. The display device may be used on a wall, a ceiling or door. A sparkling fan may be obtained by forming a display device of the present invention in a thin, disc-like shape, and attaching a handle with a battery disposed therein, to the disc-shaped display device. The display device according to the present invention may be used in many other ways.

The examples shown and described heretofore are only typical ones, and any people skilled in the art can consider various modifications without departing the scope of the present invention.

What is claimed is:

1. A display device having a display surface, comprising:

a multi-layered structure comprising first, second and third successively stacked insulating layers, a first conductive layer disposed between said first and second insulating layers, and a second conductive layer disposed between said second and third insulating layers, said display surface being provided by one of opposing major surfaces of said multi-layered structure, said first insulating layer being located closest to said display surface; and a plurality of light-emitting devices mounted on said display surface;

each of said first, second and third insulating layers and each of said first and second conductive layers being formed of such materials that a hole can be formed in said that layer by sticking a needle in that layer;

at least one of said first and second conductive layers being divided into a plurality of separate regions of any desired shapes;

each of said light-emitting devices having longer and shorter leads in pair, said pairs of leads being stuck into said multi-layered structure through said display surface substantially at any desired locations;

each of said longer leads, when stuck into said multi-layered structure through said display surface, extending through said first and second insulating layers and said first conductive layer at least into said second conductive layer to contact said second conductive layer, each of said longer leads having an insulating covering on such a portion thereof as to insulate that longer lead from said first conductive layer;

each of said shorter leads, when stuck into said multi-layered structure through said display surface, extending through said first conductive layer at least into said first conductive layer to contact said first conductive layer;

said first conductive layer being divided into a first plurality of separate regions, said second conductive layer being divided into a second plurality of separate regions, one of regions of one of said first and second conductive layers overlapping at least two regions of the other of said first and second conductive layers.

2. A multi-layered structure for a display device having a display surface, comprising:

first, second and third successively stacked insulating foamed plastic layers;

a first conductive layer sandwiched between said first and second foamed plastics layers for supplying power; and a second conductive layer sandwiched between said second and third plastics layers for supplying power;

said display surface being provided by one of opposing major surfaces of said multi-layered structure;

said first insulating layer being located closest to said display surface;

each of said first, second and third insulating foamed layers being capable of forming a hole therein by sticking a needled into that layer;

each of said first and second conductive layer comprising a layer of fibers coated with metal and capable of forming a hole therein by sticking a needle into that layer;

said multi-layered structure being adapted such that leads of a light-emitting device can be stuck into said multi-layered structure through said display surface substantially at any desired locations;

at least one of said first and second conductive layers being divided into a plurality of separate regions;

each of said plurality of separate regions being connected through a switch to a power supply.

* * * * *